US009808930B1

(12) United States Patent
Liu

(10) Patent No.: US 9,808,930 B1
(45) Date of Patent: Nov. 7, 2017

(54) TOOL CABINET

(71) Applicant: Chia-Ming Liu, Yunlin County (TW)

(72) Inventor: Chia-Ming Liu, Yunlin County (TW)

( * ) Notice: Subject to any disclaimer, the term of this patent is extended or adjusted under 35 U.S.C. 154(b) by 0 days.

(21) Appl. No.: 15/362,616

(22) Filed: Nov. 28, 2016

(30) Foreign Application Priority Data

Aug. 24, 2016 (CN) ..... 2016 2 0929891

(51) Int. Cl.

| | |
|---|---|
| ***A47B 46/00*** | (2006.01) |
| ***B25H 1/10*** | (2006.01) |
| ***A47B 81/00*** | (2006.01) |
| ***A47B 96/18*** | (2006.01) |
| ***A47B 31/00*** | (2006.01) |
| ***B25H 1/12*** | (2006.01) |
| ***B25H 1/04*** | (2006.01) |
| ***B25H 3/04*** | (2006.01) |

(52) U.S. Cl.
CPC ..... *B25H 1/10* (2013.01); *A47B 31/00* (2013.01); *A47B 46/005* (2013.01); *A47B 81/00* (2013.01); *A47B 96/18* (2013.01); *B25H 1/04* (2013.01); *B25H 1/12* (2013.01); *B25H 3/04* (2013.01); *A47B 2031/003* (2013.01)

(58) Field of Classification Search
CPC ..... A47B 31/00; A47B 46/00; A47B 46/005; A47B 81/00; A47B 96/18; A47B 17/02; B25H 1/04; B25H 1/08; B25H 1/10; B25H 1/12; B25H 3/04
USPC ..... 312/196, 319.5, 319.8, 306, 312, 902, 312/290; 211/13.1, 59.1, 70.6
See application file for complete search history.

(56) References Cited

U.S. PATENT DOCUMENTS

| | | | | |
|---|---|---|---|---|
| 1,459,930 | A * | 6/1923 | Riehle | B25H 1/04 144/285 |
| 2,019,455 | A * | 10/1935 | Lehman | A47B 17/02 312/196 |
| 3,245,741 | A * | 4/1966 | Bartlett | A47B 17/02 312/196 |
| 3,297,387 | A * | 1/1967 | Parsons | A47B 29/00 112/217.1 |
| 4,285,556 | A * | 8/1981 | Loeffel | B25H 3/023 206/372 |
| 4,740,044 | A * | 4/1988 | Taylor | A47B 21/03 312/196 |
| 8,033,620 | B2 * | 10/2011 | Retchloff | B25H 3/00 312/290 |
| 2002/0101139 | A1 * | 8/2002 | Lee | A47B 21/0073 312/196 |
| 2005/0046315 | A1 * | 3/2005 | Doane | A47B 17/02 312/196 |

* cited by examiner

*Primary Examiner* — James O Hansen
(74) *Attorney, Agent, or Firm* — LeClairRyan

(57) ABSTRACT

A tool cabinet includes a cabinet body, a hanging board having a plurality of hanging portions, two slide rail units, and at least one counterweight device. Each of the slide rail units is connected between the cabinet body and the hanging board and extends in an up-down direction, such that the hanging board is movable in the up-down direction relative to the cabinet body between a lifted position and a lowered position. The counterweight device includes a constant force spring having free and fixed ends that are respectively connected to the hanging board and the cabinet body, and providing a resilient force against the weight of the hanging board during movement between the lifted and lowered positions.

7 Claims, 6 Drawing Sheets

TOOL CABINET

CROSS-REFERENCE TO RELATED APPLICATION

This application claims priority of Chinese Patent Application No. 201620929891.3, filed on Aug. 24, 2016.

FIELD

The disclosure relates to a tool cabinet, more particularly to a tool cabinet with a hanging board that is movable in an up-down direction.

BACKGROUND

Generally, a tool cabinet includes a working platform, and a plurality of drawers used for storing tools. Tools can be taken out from the drawers and used on the working platform. However, after use, if the tools are left on the working platform instead of being put back into the drawers, the working platform will become untidy after a period of time, thereby resulting in inconveniences during the working process.

Taiwanese Utility Model Patent No. 214758 discloses a conventional tool cabinet, which includes a bottom seat, and a hanging board disposed behind the bottom seat, movable in an up-down direction and used for hanging tools. With the utilization of the hanging board, the space for storing the tools increases and the tools can be orderly hung thereon. However, in order to support the weight of the tools and avoid deformation of the hanging board, the hanging board is usually made of a metal plate with significant thickness, so that the hanging board is relatively heavy and is inconvenient for the user to lift.

Another tool cabinet as disclosed in Chinese Patent No. 201979498U includes an electronic lifting device for electrically driving movement of a hanging board in the up-down direction, so that the drawbacks associated with the previous conventional tool cabinet can be avoided.

However, the electronic lifting device, which includes a motor and a linkage mechanism, has a heavy overall weight and a relatively high manufacturing cost. In addition, the electronic lifting device is limited to be used under an environment having a power supply.

SUMMARY

Therefore, an object of the disclosure is to provide a tool cabinet that can alleviate at least one of the drawbacks of the prior art.

According to the disclosure, the tool cabinet includes a cabinet body, a hanging board, two slide rail units, and at least one counterweight device. The hanging board has a hanging surface, and a plurality of hanging portions disposed on the hanging surface. Each of the slide rail units is connected between the cabinet body and the hanging board and extends in an up-down direction, such that the hanging board is movable in the up-down direction relative to the cabinet body between a lifted position, where a top end of the hanging board is distal from the cabinet body and where the hanging portions are exposed from the cabinet body, and a lowered position, where the top end of the hanging board is proximate to the cabinet body and where at least a part of the hanging portions is covered by the cabinet body. The at least one counterweight device includes a constant force spring that has a free end connected to the hanging board, and a fixed end opposite to the free end, and connected to the cabinet body. The constant force spring provides a resilient force against the weight of the hanging board during movement of the hanging board between the lifted position and the lowered position.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
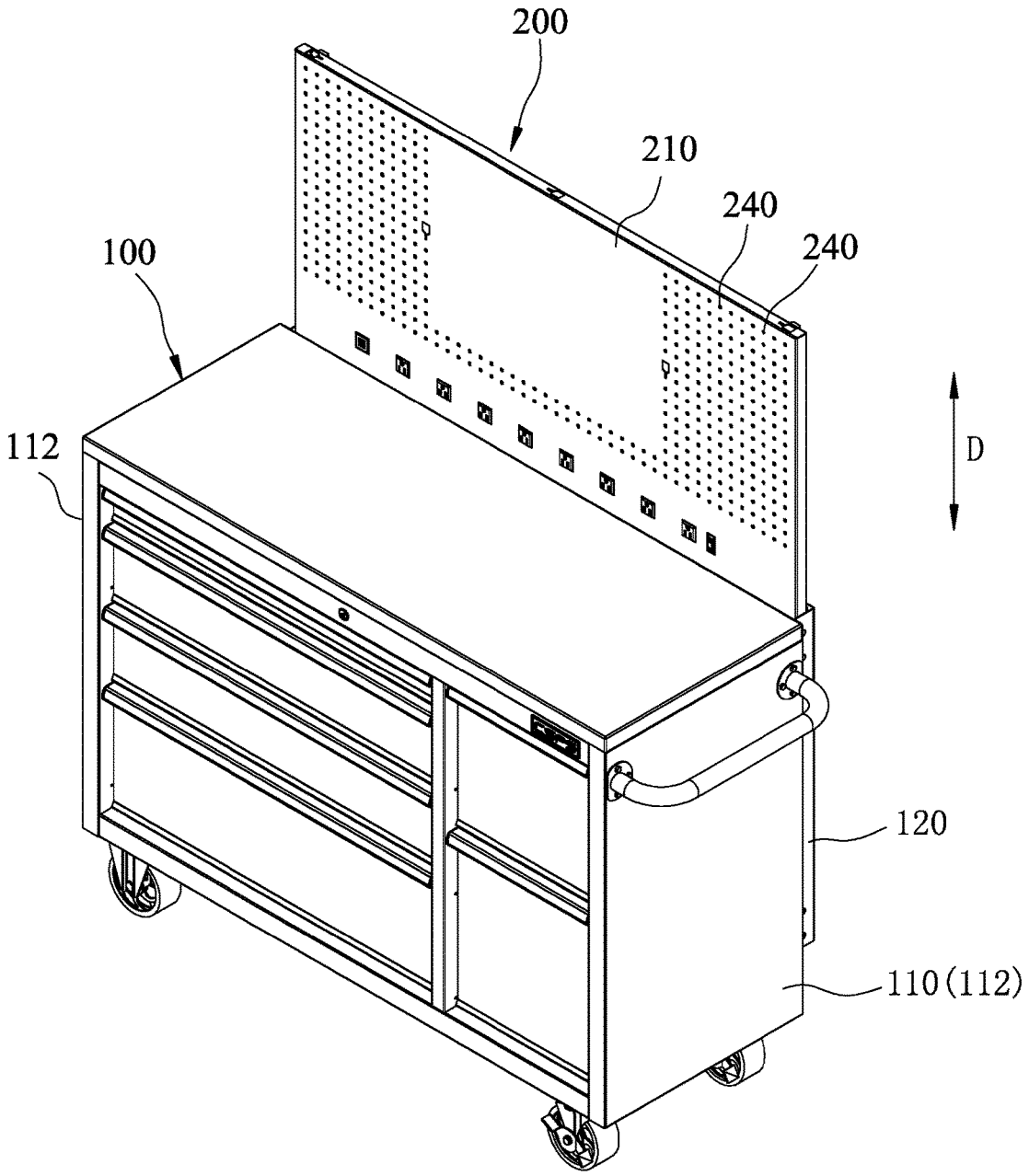
FIG. 1 is a perspective view of an embodiment of a tool cabinet according to the disclosure, illustrating a hanging board of the tool cabinet at a lifted position relative to a cabinet body.
Figure 2:
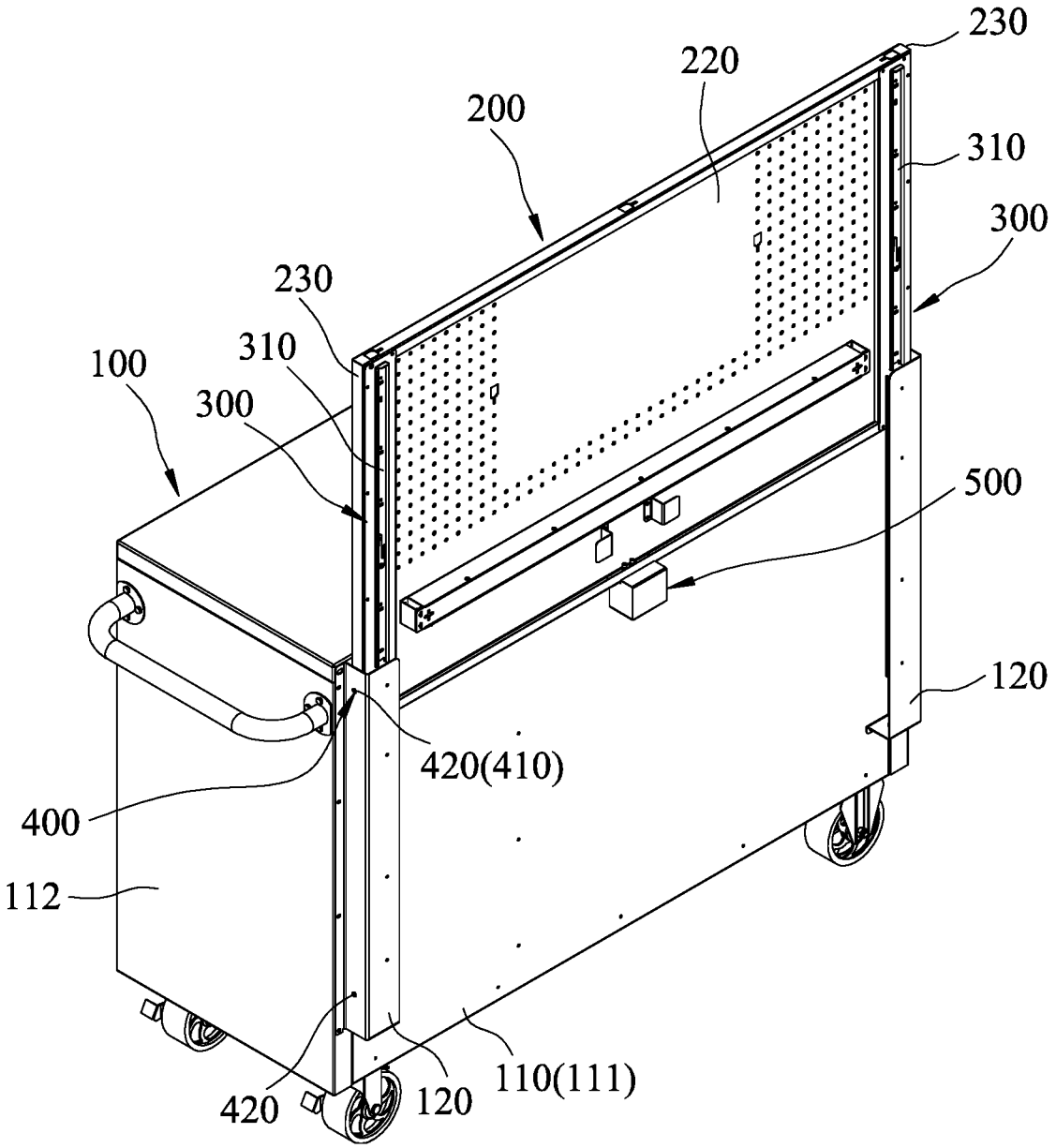
FIG. 2 is another perspective view of the embodiment, illustrating the hanging board of the tool cabinet at the lifted position.

Referring to FIGS. 1 and 2, an embodiment of a tool cabinet according to the disclosure includes a cabinet body 100, a hanging board 200, two slide rail units 300, a positioning device 400, and a counterweight device 500.

Figure 4:
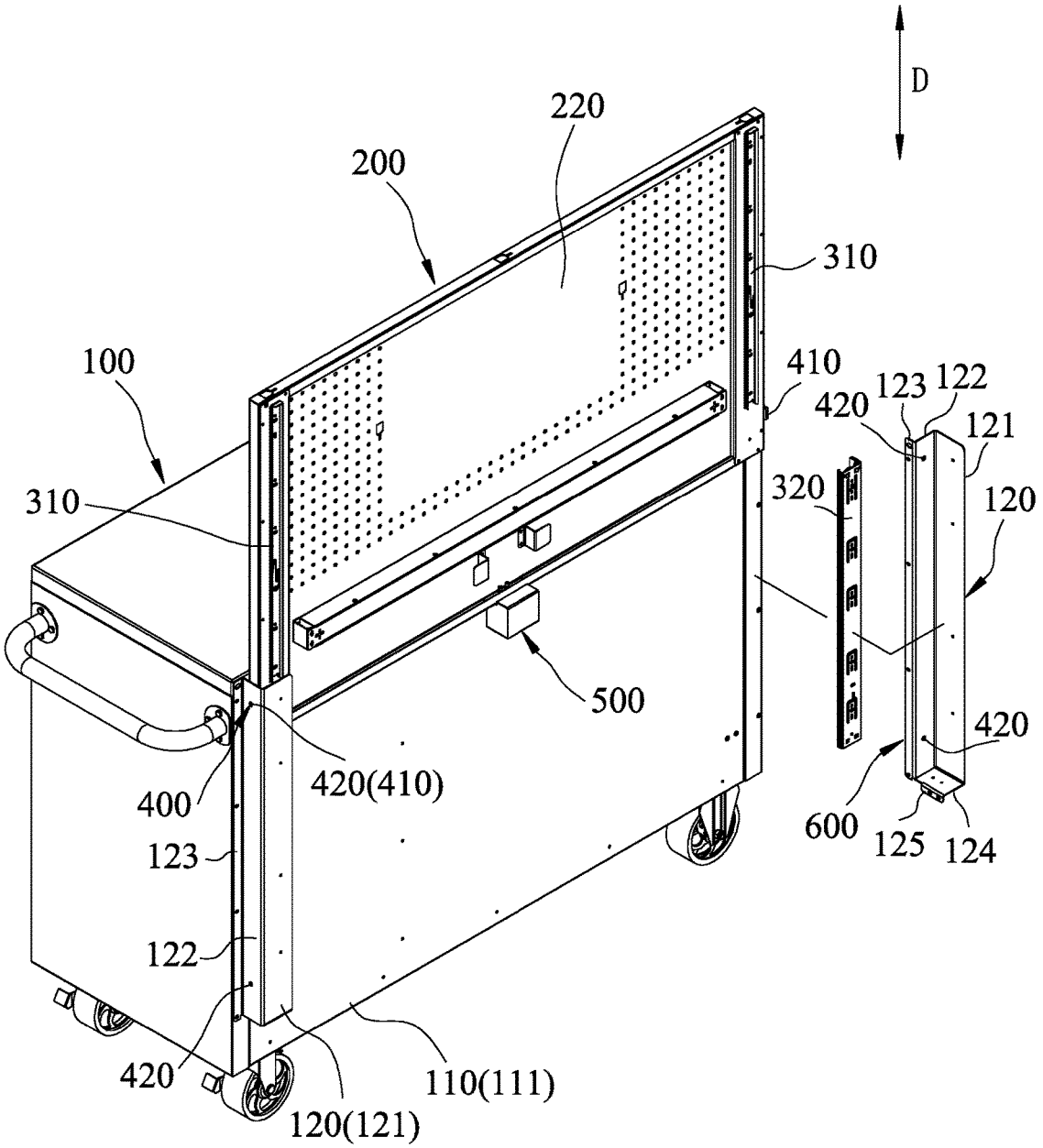
FIG. 4 is a partly exploded perspective view of the embodiment.

Referring to FIGS. 1, 2 and 4, the cabinet body 100 has a rear board portion 110, and two connecting frames 120 disposed on the rear board portion 110. The rear board portion 110 has a back board 111, and two lateral boards 112 extending respectively and forwardly from opposite lateral edges of the back board 111. The connecting frames 120 are disposed on the back board 111 of the rear board portion 110. Each of the connecting frames 120 has a vertical back wall 121, a vertical side wall 122, and a side connecting wall 123. The vertical back wall 121 and the side connecting wall 123 extend respectively from laterally opposite edges of the vertical side wall 122 and extend away from each other. Each of the connecting frames 120 further has a bottom wall 124 and a bottom connecting wall 125. The bottom wall 124 is connected to a bottom end of the vertical back wall 121 and a bottom end of the vertical side wall 122, and cooperates with the vertical back wall 121 and the vertical side wall 122 to define a slide space 600. The bottom connecting wall 125 and the vertical back wall 121 extend respectively from laterally opposite edges of the bottom wall 124 and extend away from each other. In this embodiment, each of the connecting frames 120 is disposed on the rear board portion 111 with the side connecting wall 123 and the bottom connecting wall 125 being disposed on the rear board portion 111 of the cabinet body 100, but the connecting frames 120 may be respectively disposed on the lateral boards 112 in other embodiments.

The hanging board 200 has a hanging surface 210, a back surface 220 opposite to the hanging surface 210, opposite lateral surfaces 230 interconnecting the hanging surface 210 and the back surface 220, and a plurality of hanging portions 240 disposed on the hanging surface 210. In this embodiment, the hanging portions 240 are configured as holes formed in the hanging surface 210, but the configuration of the hanging portions 240 may vary in other embodiments to meet a user's requirement, such as protrusions (not shown) extending from the hanging surface 210.

Figure 3:
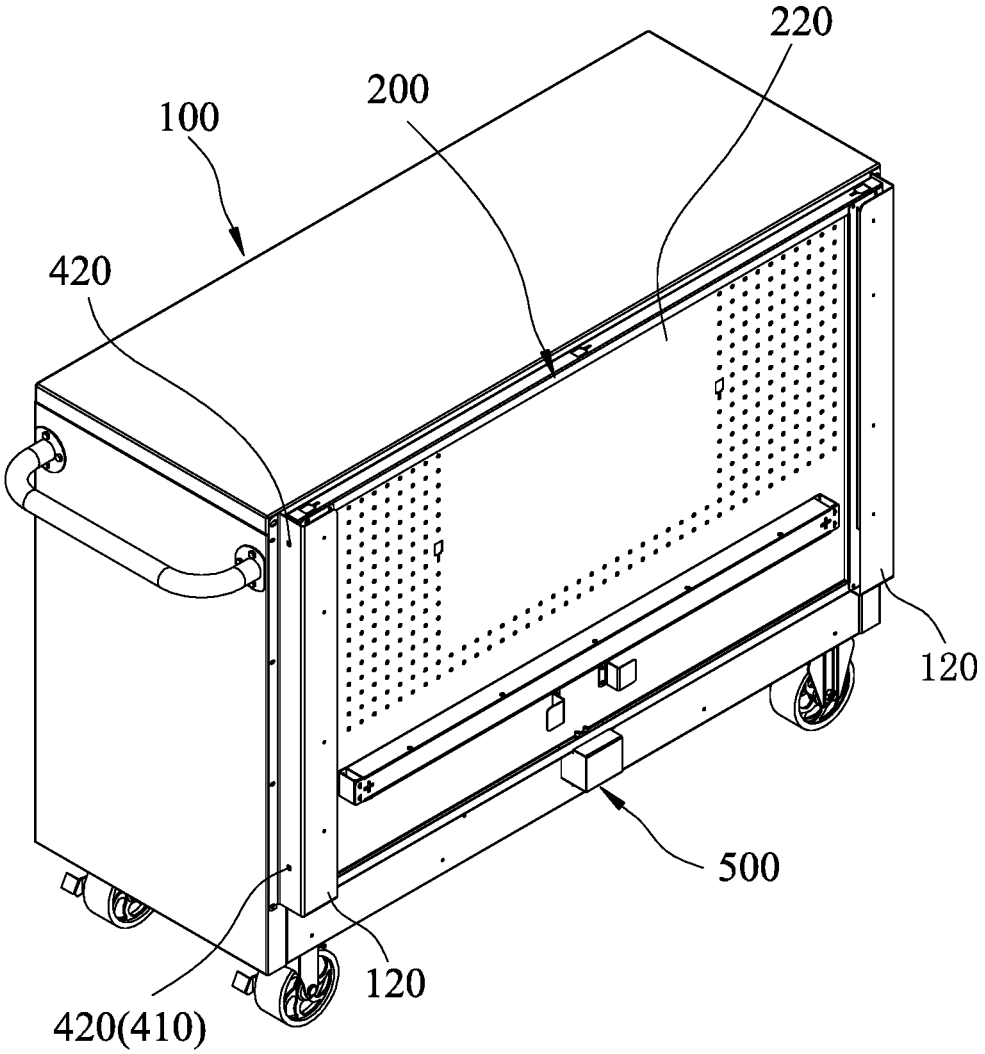
FIG. 3 is still another perspective view of the embodiment, illustrating the hanging board at a lowered position relative to the cabinet body.

Each of the slide rail units 300 is connected between the cabinet body 100 and the hanging board 200, extends in an up-down direction (D), and has a first slide rail 310 and a second slide rail 320. The first slide rails 310 of the slide rail units 300 are respectively disposed on opposite lateral end portions of the back surface 220 of the hanging board 200. The second slide rails 320 are respectively disposed on the vertical back walls 121 of the connecting frames 120 of the cabinet body 100 (i.e., the slide space 600 of each of the connecting frames 120 contains the second slide rail 320 of a respective one of the slide rail units 300 therein), and correspond respectively in position to the first slide rails 310 of the slide rail units 300. For each of the slide rail units 300, the first slide rail 310 is slidable relative to the second slide rail 320 in the up-down direction (D), such that the hanging board 200 is movable in the up-down direction (D) relative to the cabinet body 100 between a lifted position (see FIGS. 1, 2 and 4) and a lowered position (see FIG. 3). As shown in FIGS. 1 and 2, when the hanging board 200 is at the lifted position, a top end of the hanging board 200 is distal from the cabinet body 100, and the hanging portions 240 are exposed from the cabinet body 100. In this embodiment, as shown in FIG. 3, when the hanging board 200 is at the lowered position, the top end of the hanging board 200 is flush with a top end of the cabinet body 100, and the hanging portions 240 are covered by the cabinet body 100. It should be noted that, in other embodiments, when the hanging board 200 is at the lowered position, the top end of the hanging board 200 may be proximate to the cabinet body 100, so that a part of the hanging portions 240 is covered by the cabinet body 100, and another part of the hanging portions 240 is still exposed from the cabinet body 100.

Figure 6:
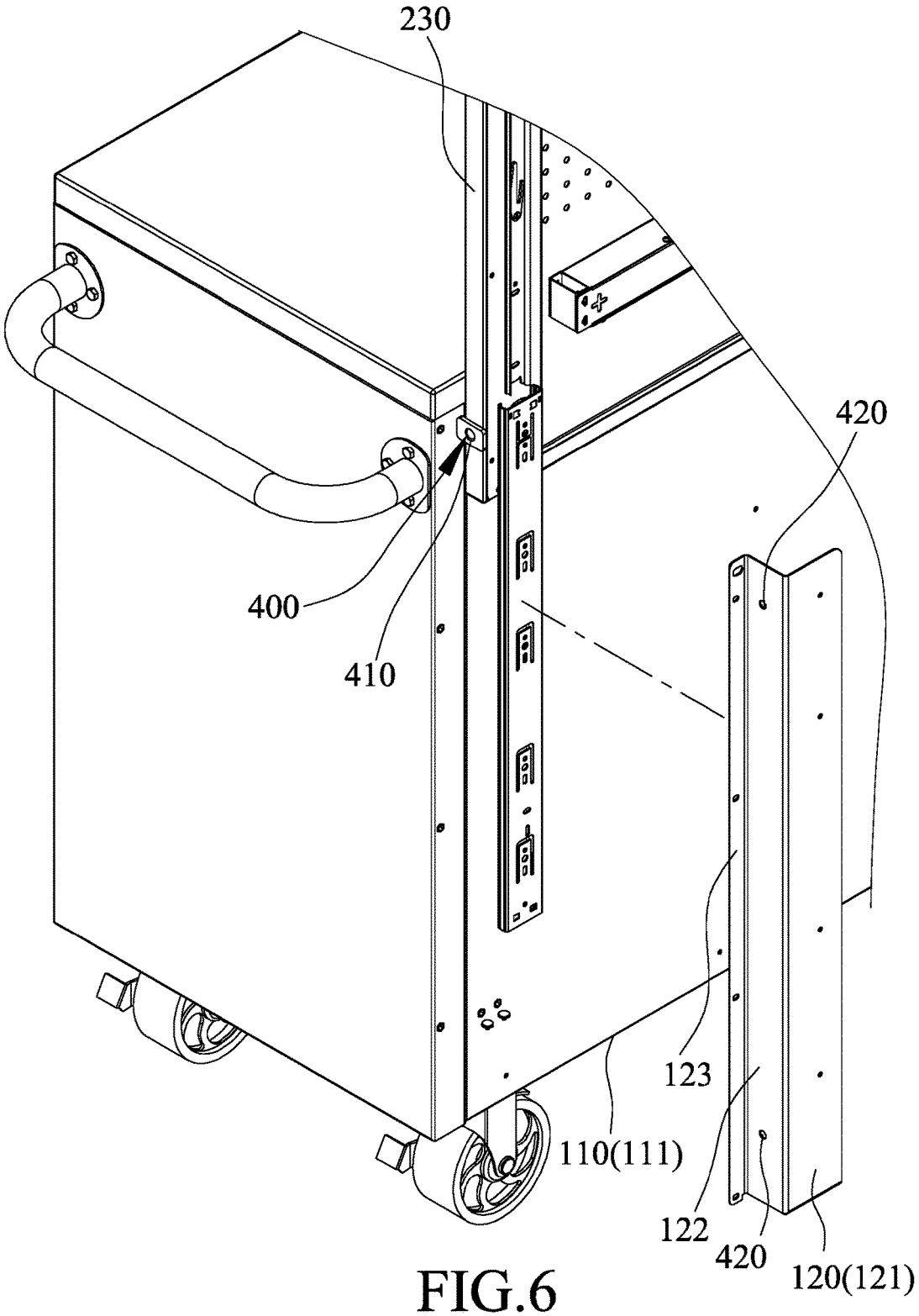
FIG. 6 is a fragmentary partly exploded perspective view of the embodiment.

Referring to FIGS. 2, 4 and 6, the positioning device 400 is connected between the hanging board 200 and the cabinet body 100. In this embodiment, the positioning device 400 has two engaging protrusions 410 respectively disposed on the lateral surfaces 230 of the hanging board 200, and two pairs of positioning holes 420. One pair of the positioning holes 420 is respectively formed in upper portions of the vertical side walls 122, and is respectively engaged with the engaging protrusions 410 when the hanging board 200 is at the lifted position for positioning the hanging board 200 relative to the cabinet body 100. The other one pair of the positioning holes 420 is respectively formed in lower portions of the vertical side walls 122, and is respectively engaged with the engaging protrusions 410 when the hanging board 200 is at the lowered position.

It should be noted that the positioning device 400 may be used only for positioning the hanging board 200 at the lifted position, so that the positioning device 400 may have only one pair of the positioning holes 420 respectively formed in upper portions of the vertical side walls 122 in other embodiments. The positioning device 400 may also have more than two pairs of the positioning holes 420 for maintaining the hanging board 200 in at least three different positions to meet the user's requirement. In addition, each of the engaging protrusions 410 may be configured to be resiliently retractable relative to a respective one of the lateral surfaces 230 of the hanging board 200 so as to facilitate disengagement of the protrusions 410 from the corresponding engaging holes 420 and the movement of the hanging board 200 in the up-down direction.

It should be noted that, the positioning device 400 may be located on the slide rail units 300. For example, each of the engaging protrusions 410 is provided on the first slide rail 310 of a respective one of the slide rail units 300, and each pair of the engaging holes 420 is formed respectively in the second slide rails 320 of the slide rail units 300.

Figure 5:
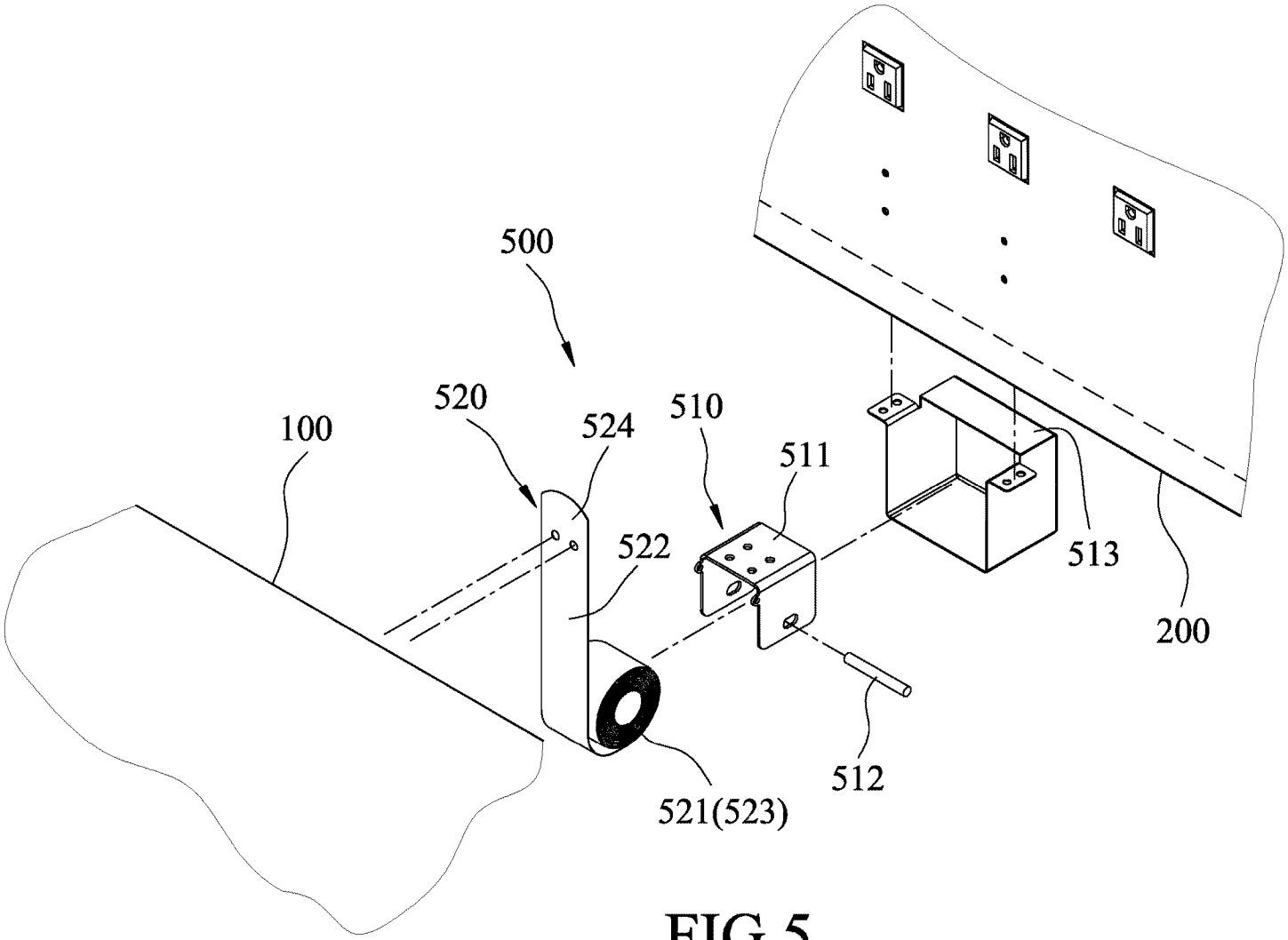
FIG. 5 is an enlarged exploded perspective view of a counterweight device of the embodiment.

Referring to FIGS. 2, 4 and 5, the counterweight device 500 has a rotation module 510 and a constant force spring 520. The rotation module 510 includes a roller bracket 511 disposed on a bottom end of the hanging board 200, a roller shaft 512 disposed on the roller bracket 511, and a cover 513 connected to the bottom end of the hanging board 200. The constant force spring 520 is made of metal and includes a ring-shaped winding portion 521 wound on the roller shaft 512, and a straight extending portion 522 connected to the winding portion 521. In this embodiment, the constant force spring 520 has a fixed end 524 formed on the extending portion 522 and connected to the cabinet body 100, and a free end 523 opposite to the fixed end 524, formed on the winding portion 521, and connected to the hanging board 200 via the roller shaft 512 and the cover 513. The constant force spring 520 provides a resilient force against the weight of the hanging board 200 during movement of the hanging board 200 between the lifted position and the lowered position. Consequently, the user needs less effort when lifting and lowering the hanging board 200.

In this embodiment, since the rotation module 510 is disposed on the bottom end of the hanging board 200, the winding portion 521 is co-movable with the hanging board 200 in the up-down direction (D). In other embodiments, the constant force spring 520 may be inverted, such that the winding portion 521 has the fixed end 524 and is connected to the cabinet body 100, and that the extending portion 522 has the free end 523 and is connected to the hanging board 200.

It should be noted that, the number of the rotation module 510 is the same as that of the constant force spring 520. The counterweight device 500 may have more than one constant force spring 520 in other embodiments. With the disposition of the roller bracket 511, the extending portion 522 of the constant force spring 520 is limited to being parallel to the line of gravity of the hanging board 200, such that, during the movement of the hanging board 200 in the up-down direction (D), the constant force spring 520 will not become spiral when being unwound, thereby ensuring smooth movement of the hanging board 200. Moreover, the cover 513 of the rotation module 510 is used for preventing the winding portion 521 from interference of external objects.

From the above description, the hanging board 200 is relatively easy to be lifted and lowered by virtue of the resilient force of the constant force spring 520. Instead of using the electronic lifting device of the aforementioned conventional tool cabinet, the tool cabinet according to the present disclosure can be applied to various working environments. The overall weight and the manufacturing cost of the tool cabinet can be reduced.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular future, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A tool cabinet comprising:

a cabinet body;

a hanging board having a hanging surface, and a plurality of hanging portions disposed on said hanging surface;

two slide rail units, each of which is connected between said cabinet body and said hanging board and extends in an up-down direction, such that said hanging board is movable in the up-down direction relative to said cabinet body between a lifted position, where a top end of said hanging board is distal from said cabinet body and where said hanging portions are exposed from said cabinet body, and a lowered position, where said top end of said hanging board is proximate to said cabinet body and where at least a part of said hanging portions is covered by said cabinet body;

at least one counterweight device including a constant force spring that has a free end connected to said hanging board, and a fixed end opposite to said free end, and connected to said cabinet body, said constant force spring providing a resilient force against the weight of said hanging board during movement of said hanging board between the lifted position and the lowered position;

wherein said tool cabinet further comprises a positioning device that is connected between said hanging board and said cabinet body, and that is operable for positioning said hanging board at the lifted position;

wherein each of said slide rail units has a first slide rail and a second slide rail, said first slide rail being slidable relative to said second slide rail in the up-down direction;

wherein said first slide rails of said slide rail units are disposed respectively on two lateral end portions of said hanging board;

wherein said second slide rails of said slide rail units are disposed on said cabinet body, and correspond respectively in position to said first slide rails of said slide rail units;

wherein said hanging board further has a back surface opposite to said hanging surface;

wherein said cabinet body has a rear board portion, and two connecting frames disposed on said rear board portion; and wherein said first slide rails are respectively disposed on opposite lateral end portions of said back surface, and said second slide rails are respectively disposed on said connecting frames.

2. The tool cabinet as claimed in claim 1, wherein:

each of said connecting frames has a vertical back wall, a vertical side wall, and a side connecting wall, said vertical back wall and said side connecting wall extending respectively from laterally opposite edges of said vertical side wall and extending away from each other;

each of said connecting frames further has a bottom wall connected to a bottom end of said vertical back wall and a bottom end of said vertical side wall, and cooperating with said vertical back wall and said vertical side wall to define a slide space for containing said second slide rail of a respective one of said slide rail units;

each of said connecting frames further has a bottom connecting wall, said bottom connecting wall and said vertical back wall extending respectively from laterally opposite edges of said bottom wall and extending away from each other; and said side connecting wall and said bottom connecting wall are disposed on said rear board portion of said cabinet body.

3. The tool cabinet as claimed in claim 2, wherein:

said hanging board further has opposite lateral surfaces interconnecting said hanging surface and said back surface; and said positioning device has at least one pair of positioning holes, each pair being respectively formed in said vertical side walls of said connecting frames, and two engaging protrusions respectively disposed on said lateral surfaces of said hanging board, and respectively engaging said positioning holes when said hanging board is at the lifted position for positioning said hanging board relative to said cabinet body.

4. The tool cabinet as claimed in claim 3, wherein:

said positioning device has two pairs of said positioning holes;

one pair of said positioning holes is respectively formed in upper portions of said vertical side walls of said connecting frames, and is respectively engaged with said engaging protrusions when said hanging board is at the lifted position; and the other one pair of said positioning holes is respectively formed in lower portions of said vertical side walls of said connecting frames, and is respectively engaged with said engaging protrusions when said hanging board is at the lowered position.

5. The tool cabinet as claimed in claim 1, wherein:

said rear board portion has a back board, and two lateral boards extending respectively and forwardly from opposite lateral edges of said back board; and said connecting frames are disposed on said back board of said rear board portion.

6. The tool cabinet as claimed in claim 1, wherein said constant force spring includes:

a ring-shaped winding portion having said free end of said constant force spring; and a straight extending portion connected to said winding portion and having said fixed end of said constant force spring.

7. The tool cabinet as claimed in claim 6, wherein said counterweight device further has a rotation module including:

a roller bracket that is disposed on a bottom end of said hanging board; and a roller shaft that is disposed on said roller bracket, said winding portion of said constant force spring being wound on said roller shaft.

* * * * *